US008943653B2

(12) United States Patent
Ramsauer

(10) Patent No.: US 8,943,653 B2
(45) Date of Patent: Feb. 3, 2015

(54) HINGE FOR MOUNTING IN AN OPENING

(76) Inventor: Dieter Ramsauer, Schwelm (DE)

( * ) Notice: Subject to any disclaimer, the term of this patent is extended or adjusted under 35 U.S.C. 154(b) by 0 days.

(21) Appl. No.: 10/587,445

(22) PCT Filed: Jan. 26, 2005

(86) PCT No.: PCT/EP2005/000730

§ 371 (c)(1),
(2), (4) Date: Jul. 25, 2006

(87) PCT Pub. No.: WO2005/071198

PCT Pub. Date: Aug. 4, 2005

(65) Prior Publication Data

US 2007/0157435 A1 Jul. 12, 2007

(30) Foreign Application Priority Data

Jan. 26, 2004 (DE) ..... 20 2004 001 161 U
Feb. 27, 2004 (DE) ..... 20 2004 003 238 U
Mar. 22, 2004 (DE) ..... 20 2004 004 593 U

(51) Int. Cl.
*E05D 5/00* (2006.01)
*E05D 7/12* (2006.01)
*E05D 5/02* (2006.01)
*E05D 5/06* (2006.01)

(52) U.S. Cl.
CPC ..... *E05D 7/123* (2013.01); *E05D 5/023* (2013.01); *E05D 5/065* (2013.01); *E05Y 2900/20* (2013.01); *E05Y 2900/208* (2013.01)
USPC ..... 16/383; 16/382; 16/258; 411/342

(58) Field of Classification Search
CPC ..... E05B 9/08; E05B 1/0092
USPC ..... 16/249, 254, 382, 387, 388, 389, 270, 16/271, 383, 252, 258; 411/918, 508, 913, 411/342, 919; 24/458, 453, 293–295, 297
See application file for complete search history.

(56) References Cited

U.S. PATENT DOCUMENTS

| | | | | | |
|---|---|---|---|---|---|
| 25,386 | A | * | 9/1859 | Clayton | 24/101 R |
| 156,828 | A | * | 11/1874 | Taylor | 24/611 |
| 997,433 | A | * | 7/1911 | Adler | 16/270 |
| 1,426,239 | A | * | 8/1922 | Witzberger | 411/385 |
| 1,520,179 | A | * | 12/1924 | Ekman | 16/389 |

(Continued)

FOREIGN PATENT DOCUMENTS

| | | |
|---|---|---|
| EP | 0 223 871 | 6/1987 |
| EP | 0 258 491 | 3/1988 |

(Continued)

*Primary Examiner* — Emily Morgan
(74) *Attorney, Agent, or Firm* — Frommer Lawrence & Haug LLP

(57) ABSTRACT

A hinge has at least one hinge part which can be mounted in an opening in a thin wall such as a sheet-metal cabinet door, a head part, such as a flange or hinge leaf, which overlaps the rim of the opening of the thin wall on its (outer) side, and a body part which proceeds from the head part and can be pushed through the opening in the thin wall, and a holding part which is carried by the body part, supported on the other (rear) side of the thin wall, and is separate from the body part. The holding part is formed by holding elements which project in a flexible manner from the body part in the direction of its outer surface and whose free end has an inclined surface for supporting the body part on the rim or edge of the opening without play.

14 Claims, 12 Drawing Sheets

(56) References Cited

U.S. PATENT DOCUMENTS

| | | | | |
|---|---|---|---|---|
| 1,538,320 | A * | 5/1925 | Gullong | 40/663 |
| 1,576,081 | A * | 3/1926 | Benjamin | 49/177 |
| 1,950,205 | A * | 3/1934 | Young | 40/203 |
| 3,150,556 | A * | 9/1964 | Churchill | 411/520 |
| 3,362,276 | A * | 1/1968 | Gould | 411/512 |
| 3,426,817 | A * | 2/1969 | Andrews et al. | 411/173 |
| 3,583,736 | A * | 6/1971 | Willimzik | 292/16 |
| 3,952,364 | A * | 4/1976 | Lautenschlaeger, Jr. | 16/233 |
| 5,435,159 | A * | 7/1995 | Ramsauer | 70/370 |
| 5,904,462 | A * | 5/1999 | Gonzalez | 411/342 |
| 6,175,992 | B1 * | 1/2001 | Sauerland | 16/382 |
| 6,247,744 | B1 * | 6/2001 | Townsend et al. | 296/146.11 |
| 6,286,185 | B1 * | 9/2001 | Ramsauer | 16/236 |
| 6,554,526 | B1 * | 4/2003 | Egelandsdal | 403/294 |
| 6,568,032 | B1 * | 5/2003 | Ramsauer | 16/329 |
| 6,840,552 | B2 * | 1/2005 | Ramsauer | 292/336.3 |
| 7,360,279 | B2 * | 4/2008 | Hoffmann et al. | 16/382 |
| 8,517,653 | B2 * | 8/2013 | Ramsauer | 411/347 |
| 8,667,819 | B2 * | 3/2014 | Ramsauer | 70/208 |
| 2007/0175252 | A1 * | 8/2007 | Ramsauer | 70/370 |

FOREIGN PATENT DOCUMENTS

| | | |
|---|---|---|
| EP | 0 528 213 | 2/1993 |
| EP | 1 191 175 | 3/2002 |

* cited by examiner

Fig.11A.
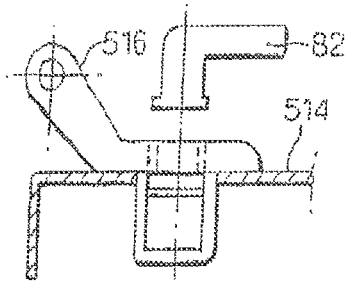
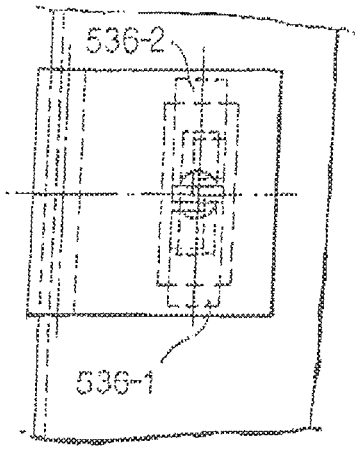
Fig.11B.
Fig.11C.
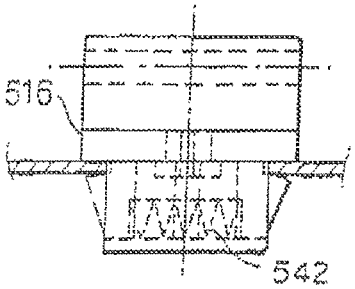
Fig.11D.
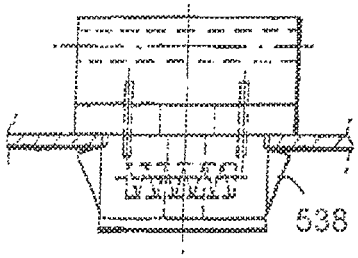
Fig.11E.
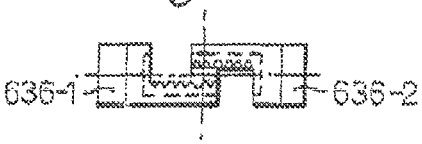
Fig.11F.
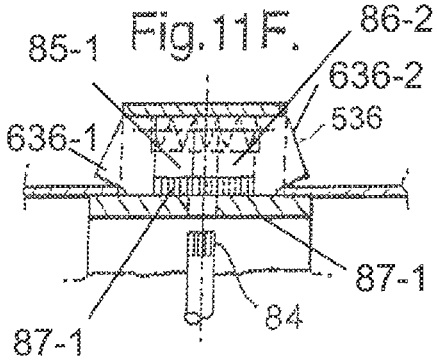
Fig.12A.
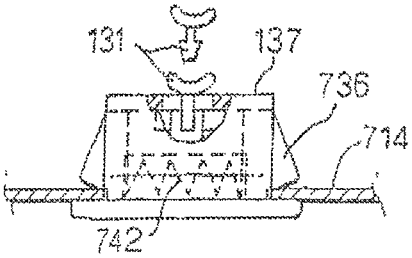
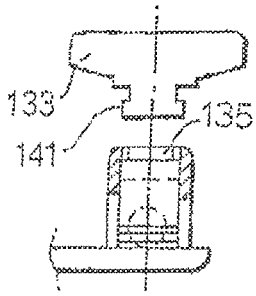
Fig.12B.

Fig.12C.
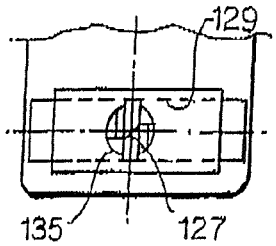
Fig.12D.
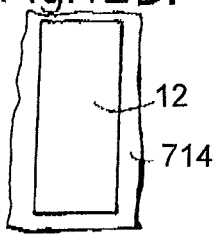
Fig.12E.
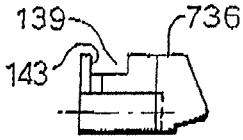
Fig.12F.
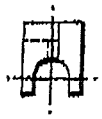
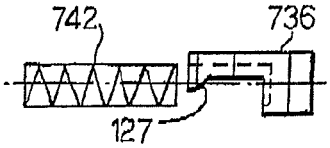
Fig.12G.
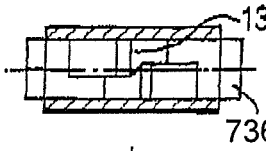
Fig.12H.
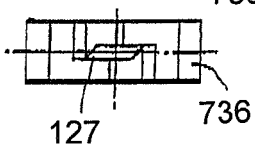
Fig.12I.
Fig.12J.
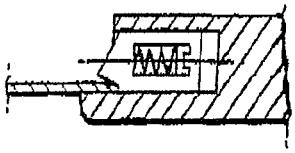
Fig.12K.
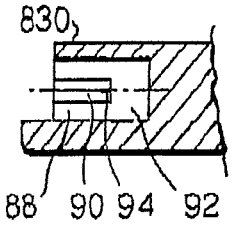
Fig.12L.
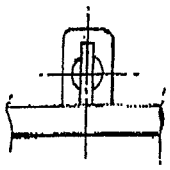
Fig.12M.
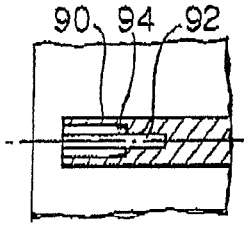
Fig.12N.
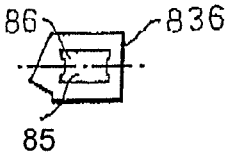
Fig.12O.
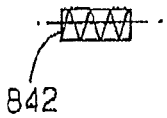
Fig.12P.
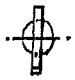

Fig.13A.
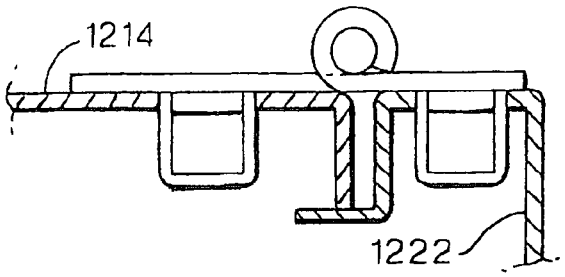
Fig.13B.
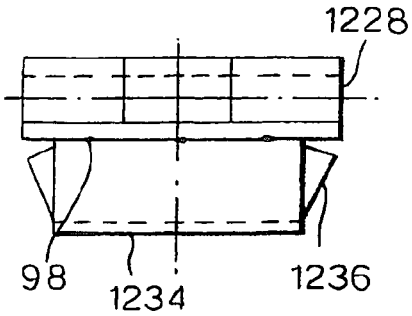
Fig.13C.
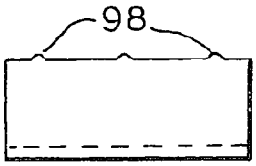
Fig.13D.
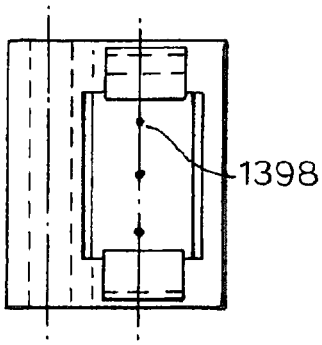
Fig.13E.
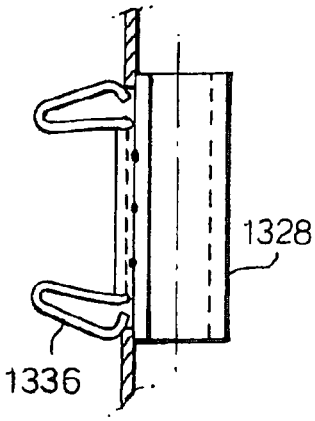
Fig.14A.
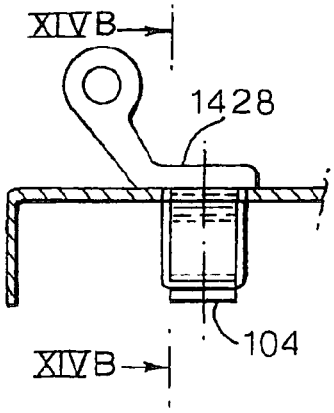
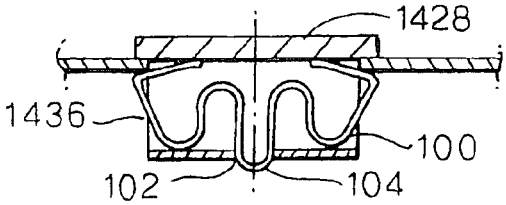
Fig.14B.

Fig.17A.
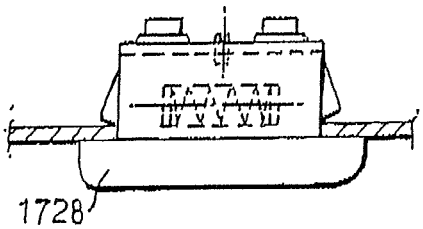
Fig.17B.
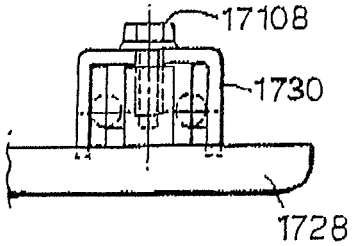
Fig.17C.
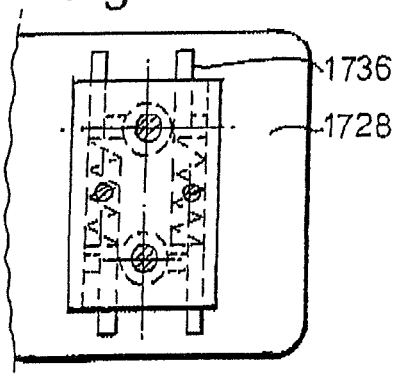
Fig.18B.
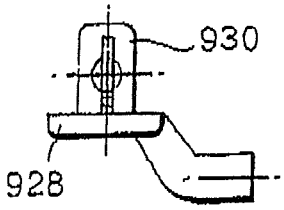
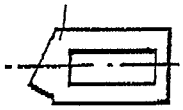
Fig.18D.
Fig.18E.
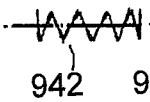
Fig.18F.
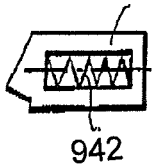
Fig.18A.
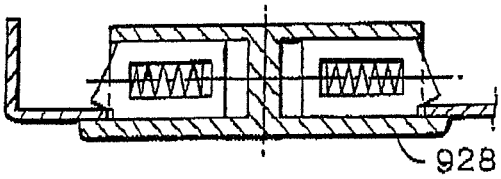
Fig.18G.
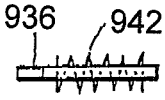
Fig.18C.
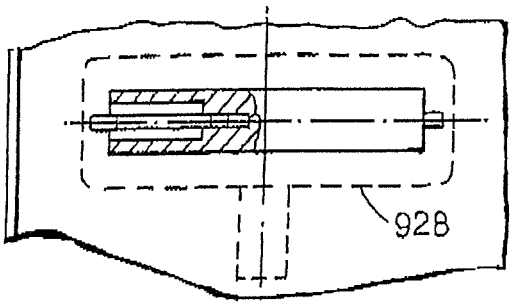
Fig.18H.
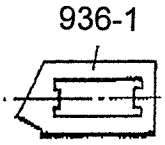
Fig.18I.
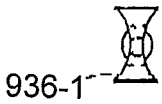

Fig.19A.
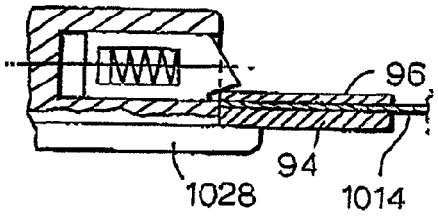
Fig.19B.
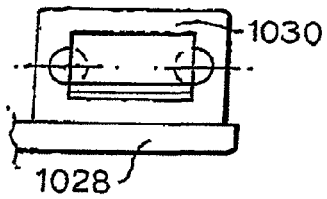
Fig.19C.
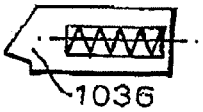
Fig.19D.
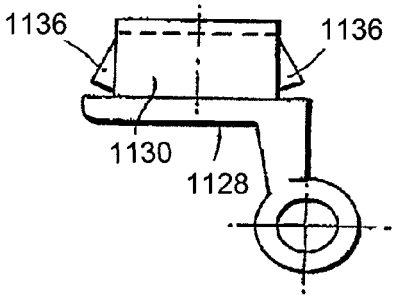
Fig.19E.
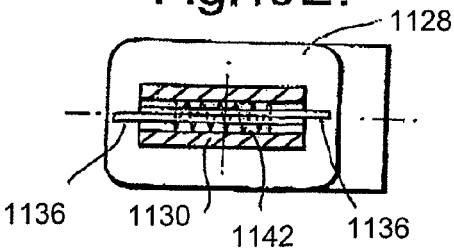
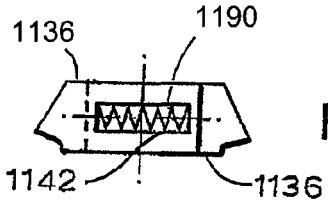
Fig.19F.
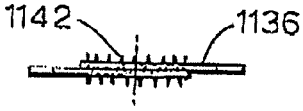
Fig.19G.
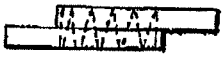
Fig.19H.

Fig.20A.
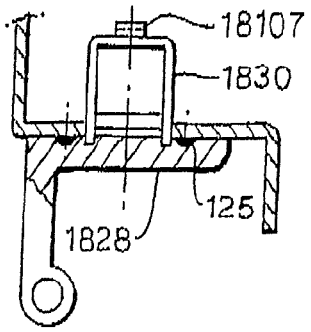
Fig.20B.
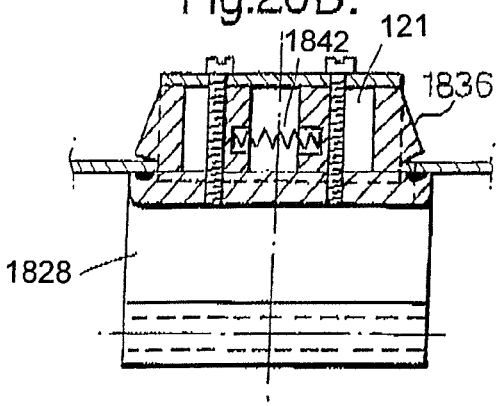
Fig.20C.
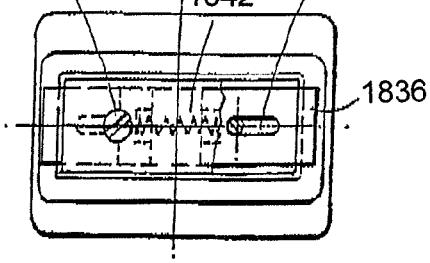
Fig.20D.
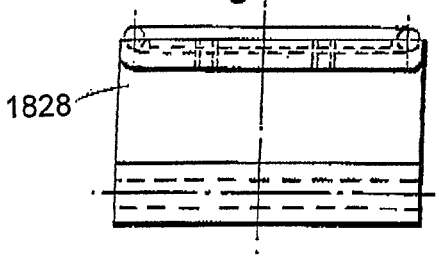
Fig.20E.
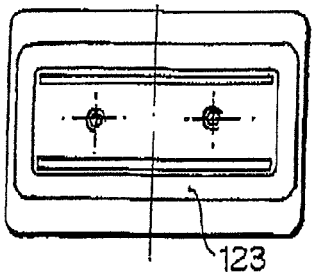
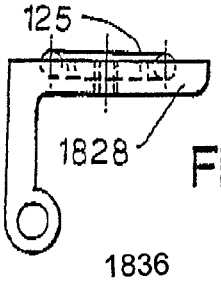
Fig.20F.
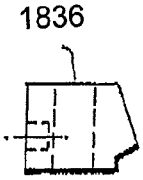
Fig.20I.
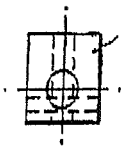
Fig.20J.
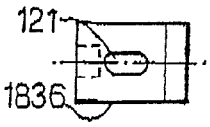
Fig.20G.
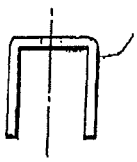
Fig.20K.
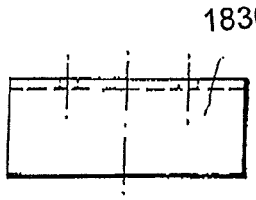
Fig.20L.
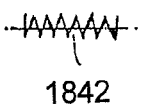
Fig.20H.

HINGE FOR MOUNTING IN AN OPENING

CROSS-REFERENCE TO RELATED APPLICATIONS

This application claims priority of International Application No. PCT/EP2005/000730, filed Jan. 26, 2005, and German Application No. 20 2004 001 161.1, filed Jan. 26, 2004, German Application 20 2004 003 238.4, filed Feb. 27, 2004, and German Application No. 20 2004 004 593.1, filed Mar. 22, 2004, the complete disclosures of which are hereby incorporated by reference.

BACKGROUND OF THE INVENTION

The invention is directed to a hinge having at least one hinge part which can be mounted in an opening in a thin wall such as a sheet-metal cabinet door, with a head part such as a flange or hinge leaf which overlaps the rim of the opening of the thin wall on an (external) side thereof, and a body part which proceeds from the head part and can be slid through the opening in the thin wall, and with a holding part which is carried by the body part and supported on the other (back) side of the thin wall.

BRIEF DESCRIPTION OF THE RELATED ART

A hinge of the type mentioned above is already known from EP 0223871 A1. In the prior art, the holding part comprises a pin 20 which is guided through corresponding bore holes of one hinge part and securely holds this hinge part in the corner area of a sheet-metal switch cabinet. This type of assembly has the advantage that it enables a stable fastening of the door leaf to a door frame even in relatively thin sheet metal, which is often not true of screw hinges.

However, it is disadvantageous that the hinge is only suitable for very specific thicknesses of sheet metal, and thicknesses of sheet metal differing therefrom lead to play or to the impossibility of mounting. Further, the pin, as a loose part, can be lost.

Further, the mounting is still somewhat complicated. In particular, both sides of the door leaf must be accessible.

OBJECT AND SUMMARY OF THE INVENTION

It is the primary object of the invention to further improve the known arrangement, particularly with respect to simplifying mounting and adapting to different sheet metal thickness of the thin wall automatically as far as possible. Further, loose parts should be avoided if possible.

Certain advantages already existing in the prior art will be retained when possible, for example, the inaccessibility of the hinge fastening when the cabinet is closed, and the ability to unlock the hinge fastening when the cabinet is open, at least through the use of a tool.

This object is met according to the invention in that the holding part is formed by holding elements which project in a flexible manner from the body part in the direction of its outer surface and whose free end has an inclined surface for supporting the body part on the rim or edge of the opening in the thin wall without play.

A majority of the tasks set by the invention are already fulfilled by means of this step. In particular, mounting is greatly simplified and, on the other hand, very thin sheet metal can also be securely held. Different thicknesses of sheet metal are held without play when they do not exceed determined ranges. Loose parts are usually not required.

A clip-like fastening of the kind mentioned above for the hinge in the form shown herein was not previously known. A clip fastening for quick mounting of a lock housing is known with reference to U.S. Pat. No. 5,435,159, wherein a lock housing of this kind is arranged, for example, in a round opening in a thin wall. The housing which is intended for a sash lock comprises a head part, namely, a flange, which must be arranged on an outer side of the thin wall and which overlaps the outer rim of the opening. A body part which projects through the opening in the mounted position proceeds from this head part, and flexible tongue elements project from the body part in the direction of its outer surface which has an inclined surface at the free end for supporting the body part without play on the frame of the opening of the other, inner side of the thin wall. In this case, the disadvantage is that the holding force of the holding elements or tongue elements that are integral with the body part is dependent upon their spring tension which depends upon the plastic material that is used, and therefore the magnitude of the holding force cannot be made as large as desired. However, very large forces must often be absorbed when using the hinge, so that this type of clip fastening cannot readily be transferred to a hinge part.

EP 0258491 discloses a construction similar to that known from U.S. Pat. No. 5,435,159 with which a lock cylinder can be fastened in thin-walled doors, drawers or the like by means of a plastic housing which receives the lock cylinder and forms the holding tongues. Common variations of the structural component parts to be locked can be adapted to in a desired manner by means of inclined surfaces at the ends of the tongues. It is also stated in column 9 of the reference that the springing tongues can no longer deflect inward after the lock cylinder is mounted in the housing. This prior art has the disadvantage that a very particular design, namely, a round housing with a lock cylinder inserted therein, must be provided to make it possible to lock the tongues in this way after mounting. In this case also, it does not seem obvious to transfer this tongue fastening to a hinge.

In the hinge according to the invention, in which the body part and the holding part are two separate parts and are not injection molded in one piece from plastic as in the two references cited above, the load capacity is substantially greater because, if required, a less durable plastic material which can easily be injection molded can be combined with a stronger material such as metal so that the desired strength of the hinge is achieved by a corresponding choice of material.

According to a further development of the invention, two holding elements which are arranged diametrical to one another are provided and are acted upon by pressure elements such as spring arrangements, particularly a coil spring common to the two holding elements or two coil springs or wedge arrangements such as conical screws. Since the stop bevels of the holding elements can be provided with different angles and the spring arrangements can be provided with spring force that can be freely selected, per se, the locking force can be adapted to the respective task and does not depend upon the plastic material.

In the prior art, the locking force is highly dependent upon the material characteristics of the plastic that is used unless a pin is used; but this in turn complicates mounting in an undesirable manner because blind mounting in particular is impossible. However, this can be provided according to the invention.

According to a further development of the hinge, the holding elements are levers which are arranged at a distance from the rear surface of the thin wall so as to be rotatable to a limited extent around an axis parallel to the plane of the thin wall. This embodiment form increases the holding force while retaining the same spring strength.

Alternatively, the holding elements are levers which are arranged at a distance from the rear surface of the thin wall so as to be rotatable to a limited extent around an axis perpendicular to this surface. Accordingly, four holding points can be achieved simultaneously with two levers so as to increase the holding force while the spring tension remains unchanged.

According to a further development of the invention, the holding elements are slides which are arranged so as to be displaceable in a cylinder that lies parallel to the plane of the thin wall and is rectangular in cross section and are held against the force of a pressure spring by a hook arrangement that locks between the slides themselves or in the cylinder. The advantage of this construction consists in the relatively small structural height on the rear side of the door leaf. A similar construction results when the holding elements are slides of rigid material such as metal which are arranged so as to be displaceable in a cylinder that is parallel to the plane of the thin wall and rectangular in cross section and are held against the force of a pressure spring by a pin arrangement that is arranged between them. This is a particularly durable hinge arrangement.

The cylinder can have a partial dividing wall or undercut or opening edge at which the slide can be supported axially by a shoulder or hook. This shows the variability of the design according to the invention, which is an advantage.

It is possible to reduce the size of the construction according to a further development of the invention when the holding element has an opening which receives a spiral pressure spring by at least a portion of its diameter.

Projections can project into the opening in order to hold the spring element radially.

In particular, the holding elements can be formed by two flat metal pieces lying next to one another, each of which has an opening, these two openings together forming a space which receives a spiral pressure spring by at least a portion of its diameter. The design advantageously enables pre-mounting in which these three parts are held together by the spring in such a way that they can be manipulated separately from the rest of the hinge. This is also true when the holding elements are formed by two metal pieces which lie next to one another and which form projections and recesses which are directed toward one another and which limit the axial sliding movement relative to one another. This has the additional advantage that the movement path is limited without taking further steps with respect to the cylinder.

According to a further development of this design, the holding elements are formed by two plastic pieces or metal pieces which lie next to one another and which form projections and recesses which are directed toward one another and which can be engaged by a rotatable tool or key in such a way that the plastic pieces or metal pieces are displaced relative to one another against the spring force when the tool or key is turned. This makes it possible to draw back the two holding elements that are operative in this case without taxing the finger and therefore makes it possible to disengage the hinge part from the opening of the thin wall when required. Since this is possible only with a particular tool that is not available to everyone, this is also a favorable aspect with respect to security. As was already mentioned, another advantage can be achieved in that the holding elements are formed by a metal piece or by two metal pieces lying next to one another which is/are held jointly by a spring in such a way that these three parts form a manageable unit that is stable in itself.

Instead of the pin arrangement or, in a further development of the pin arrangement, a fixing pin or fixing plug or fixing screw can also be provided for fixing the holding elements after the hinge part is mounted in the opening.

A design in which the head part has a recess in the area of the holding elements proves advantageous insofar as bulging of the rims of the opening is also innocuous if not excessive. When the rims bulge only slightly, the contact surface is increased so that even larger forces can be absorbed.

The holding element can also be formed by a leaf spring that is bent in a suitable manner. According to a further development, the leaf spring can be inserted into a radially extending cavity formed by the body part. The cavity can form a slot or recess in which a projection and recess of the spring lock the latter in a working position in a fixed manner. On the other hand, the leaf spring can be held by a head screw that is screwed into a threaded bore hole formed by the body part. Alternatively, the leaf spring can also be spot-welded or glued to a surface formed by the body part.

Alternatively, the hinge part has an opening like the thin wall, and the holding part and the body part have their own head part. The head part and body part can also be two parts that are screwed together or can also be parts that are glued together or parts that are permanently or detachably connected in some other way.

It can be advantageous to arrange a plurality of holding elements next to one another in axial direction of the hinge. On the other hand, it is also possible for a second hinge part which is swivelably connected to the first hinge part to have a construction analogous to that of the first hinge part. If required, it can be advantageous when a second hinge part which is swivelably connected to the first hinge part has a construction differing from that of the first hinge part with respect to its fastening to a frame, such as a door frame, or to a door leaf. For example, the second hinge part could be welded to the frame or door leaf. On the other hand, the second hinge part could be screwed to the frame or door leaf. Yet another alternative is to glue the second hinge part to the frame or door leaf. Finally, it is also possible to fasten the second hinge part to the frame or door leaf by means of a clamping pin as in the prior art.

BRIEF DESCRIPTION OF THE DRAWINGS

The invention will be explained more fully in the following with reference to embodiment examples shown in the drawings.

FIGS. 11A, 11B, 11C, 11D show different views of a hinge according to the invention which is detachable by means of a key;

FIGS. 11E and 11F show a modified embodiment form of a hinge that is detachable by means of a key;

FIGS. 12A, 12B and 12C show different views of another hinge that is detachable by means of a key;

FIG. 12D shows the associated opening in a thin wall;

FIGS. 12E and 12F show an associated holding element in two different views;

FIGS. 12G, 12H and 12I show additional views of this holding element during operation;

FIGS. 12J, 12K, 12L show another embodiment form of a suitable holding element;

FIGS. 12M, 12N, 12O, 12P show still another embodiment form of the holding element;

FIGS. 13A, 13B, 13C show an embodiment form with a body part that is welded to the hinge leaves;

FIGS. 13D and 13E show an embodiment form with a holding spring that is welded to the body part;

FIGS. 14A and 14B show an embodiment form with an insertable holding spring;

FIGS. 17A, 17B and 17C show an embodiment form in which the body part is screwed on;

FIGS. 18A, 18B and 18C show different views of an alternative hinge with features according to the invention;

FIGS. 18D, 18E, 18F, 18G show different views of the associated holding element;

FIGS. 18H, 18I show another embodiment form of the holding element;

FIGS. 19A, 19B, and 19C show different views of another hinge part with features according to the invention;

FIGS. 19D, 19E, 19F, and 19G show an even further hinge part and detailed views of the associated holding elements;

FIG. 19H is a front view similar to FIG. 19G showing holding elements of greater thickness;

FIGS. 20A, 20B, 20C, 20D, 20E and 20F show different views of another hinge with a fastening that is outfitted according to the invention;

FIGS. 20G, 20H, 20I, 20J show the associated fastening element;

FIGS. 20K and 20L show the associated cylinder that can be screwed on;

DESCRIPTION OF THE PREFERRED EMBODIMENTS

Figure 1A:
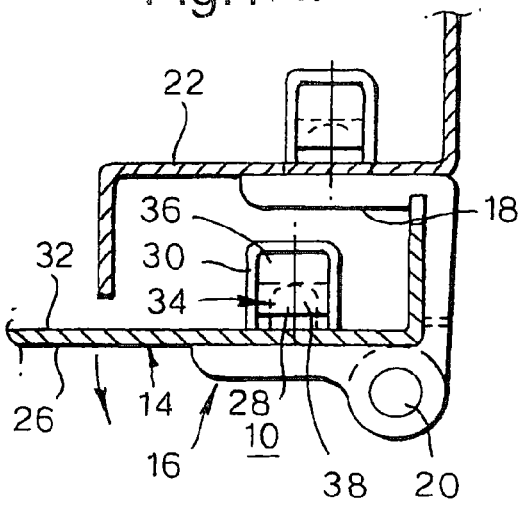
FIG. 1A shows a cross section through the bevel area of a door leaf which is hinged at a door frame by means of the hinge device according to the invention.
Figure 1B:
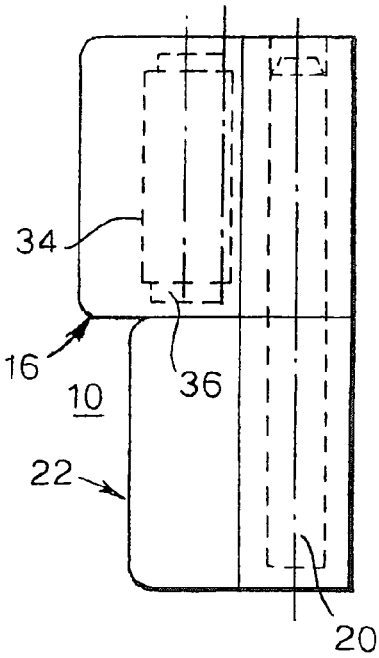
FIG. 1B is a side view of the hinge shown in FIG. 1A.
Figure 1C:
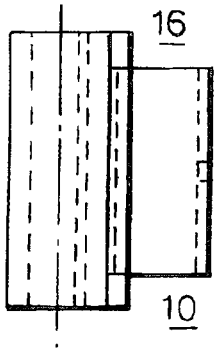
FIG. 1C is a side from the left-hand side showing the top part of the hinge shown in FIG. 1B.
Figure 1D:
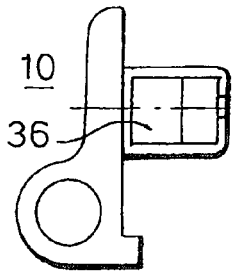
FIG. 1D shows a view of this part from the top.

FIGS. 1A, 1B, 1C and 1D show different views of a hinge 10 constructed according to the invention with at least one hinge part 16 which can be mounted in an opening 12, which is rectangular in the present case (see, e.g., FIG. 2), in a thin wall 14, such as a sheet-metal cabinet door, and another hinge part 18 which is swivelably connected to the first hinge part 16 by means of a hinge pin 20 and can be fastened to a door frame 22, see FIG. 1A. The respective hinge part 16 or 18 which can be mounted at the sheet-metal cabinet door or thin wall 14 (as well as on the frame 22) comprises a head part 28, such as a flange or, in this case, a leaf of a hinge, which overlaps the rim 24 of the opening 12 in the thin wall 14 or frame 22 on one (outer) side 26 thereof, and a body part 30 proceeding from the head part 28 which can be slid through the opening 12 in the thin wall 14, and a holding part 34 which is carried by the body part and is supported on the other (rear) side 32 and is separate from the body part 30. The holding part 34 is formed by holding elements 36. The holding element 36 projects flexibly from the body part 30 in direction of its outer surface and its free end has an inclined surface 38 for supporting the body part 30 without play on the rim or edge 40 of the opening 12 in the thin wall 14 (or frame 22). Because of the symmetry of forces, it is advantageous, e.g., according to FIG. 4B, to provide two holding elements 36-1 and 36-2 which are arranged diametrically relative to one another and which are acted upon by spring arrangements 42, for example, a coil spring 42 common to the two holding elements 36-1 and 36-2 or a coil spring 42-1, 42-2 shown in FIG. 3A in such a way that the holding elements 36, 136 are forced in the direction of the rim 40 of the through-opening 12, see FIG. 2. As is shown in FIG. 4B, the holding elements 36-1, 36-2 can be levers 44 which are arranged at a distance A from the (rear) surface 32 of the thin wall 14 around an axis 46 parallel to the plane of the thin wall 14. The angle of rotation of the levers 44 is limited by stop arrangements 48, while, in FIG. 4B, the holding elements 36 are arranged at a distance A from the (rear) surface of the thin wall so as to be rotatable to a limited extent around the axis 46.

Figure 3A:
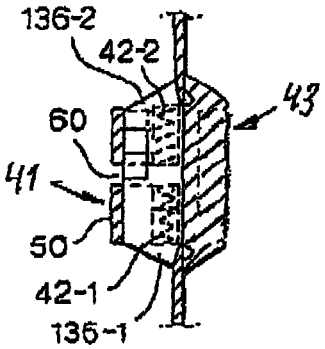
FIG. 3A shows an embodiment form of an associated holding part.
Figure 3B:
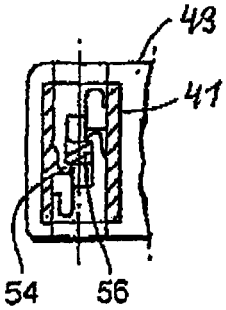
FIGS. 3B and 3C show two axial sectional views through the holding part according to FIG. 3A.
Figure 3C:
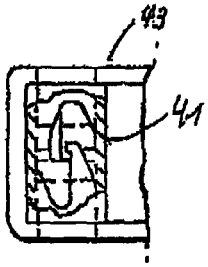
Figure 6A:
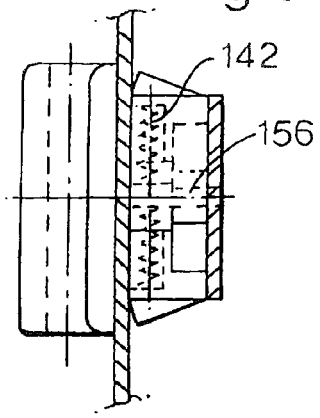
FIG. 6A is a side view partially in section.
Figure 6B:
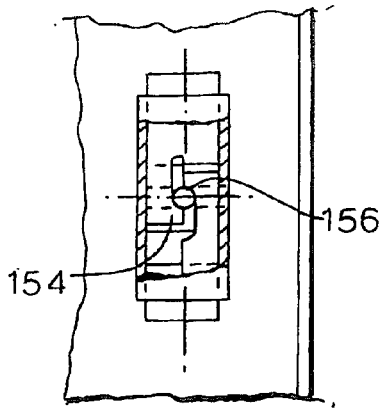
FIG. 6B is a view from the right-hand side, referring to FIG. 6A, of another embodiment form of the hinge according to the invention.

According to the view in FIG. 3A, the arrangement of the holding elements 136-1, 136-2 is carried out in such a way that they are arranged as slides 52 which are arranged so as to be axially displaceable in the cylinder 50 which is rectangular in cross section and parallel to the plane of the thin wall 14 or frame 22, which slides 52 are held against the pressure spring force of the spring 42 by a hook arrangement 54 which locks between the slides 52 themselves or in the cylinder 50, see, e.g., FIG. 3B, with the hooks 54 or (in FIG. 6B) with the hooks 154 which are supported at a wedge 56 or at a pin 156.

Figure 5A:
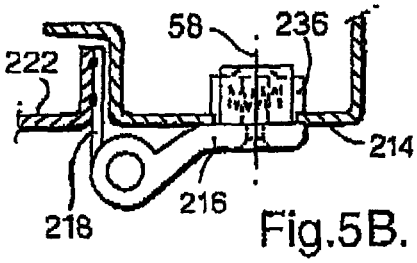
FIG. 5A is a sectional view of another embodiment form of the invention.
Figure 5B:
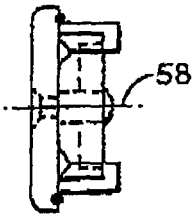
FIG. 5B shows the same embodiment form of the invention as FIG. 5A from the side.
Figure 5C:
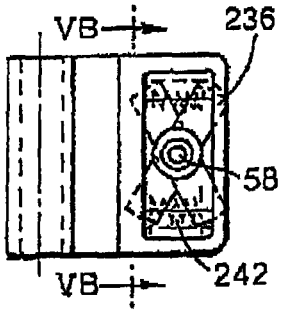
FIG. 5C is a bottom view of the same embodiment form of the invention as FIG. 5A.

According to FIGS. 5A, 5B and 5C, the holding elements 236 shown in the figures are levers 236 which are arranged so as to be rotatable to a limited extent around an axis 58 extending perpendicular to the thin wall 214.

Figure 8B:
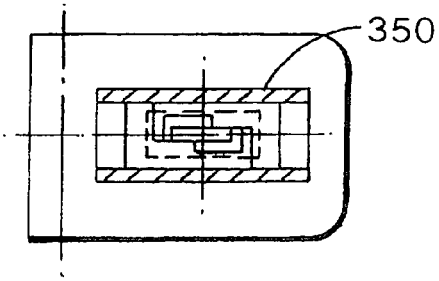
FIGS. 8B, 8C show different positions and views of the hinge according to FIG. 8A during the fastening process
Figure 8A:
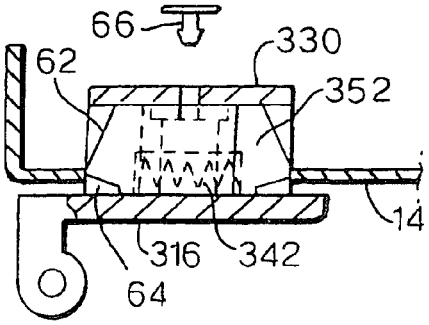
FIG. 8A is a side view of a hinge that is constructed differently.
Figure 8C:
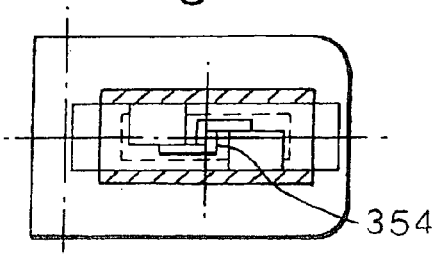
Figure 8D:
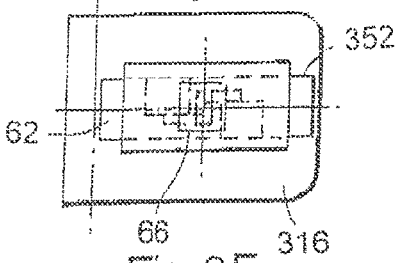
FIG. 8D shows the corner head of a stopper.
Figure 8E:
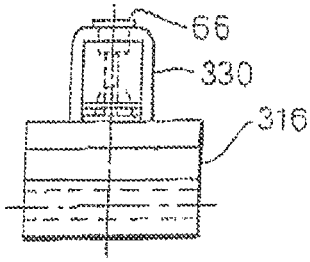
FIG. 8E is a view from the left-hand side of the arrangement shown in FIG. 8A.
Figure 8F:
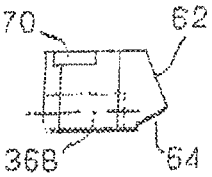
FIGS. 8F, 8G and 8H are three different views of the associated holding element.
Figure 8G:
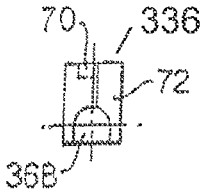
Figure 8H:
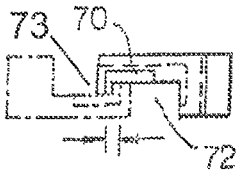

The cylinder 50 can also have a partial dividing wall or undercut or an opening edge 60 at which the slide can be supported axially by a shoulder or a hook. For example, FIG. 8A shows a hinge part 316 with a body part 330 in which slides 352 can move back against the force of a spring 342 through the edges of the opening when pushed in as a result of the bevel 62 (see FIG. 8A) until the edge has reached the clamping surface 64, in which position the spring 342 presses the two fastening elements 352 against the edges of the opening and securely connects the hinge part 316 to the thin wall 14. In order to prevent the loss of the holding elements 352 before being mounted in an opening, they are hooked to one another mutually by means of hooks 354 (see FIG. 8C). Nevertheless, it is possible for them to deflect with respect to one another when pushed in and to reach the position according to FIG. 8B. FIG. 8D shows that the middle position is secured by a fixing plug 66 in the moved out state. Further, the fixing plug 66 prevents the removal of the hinge in that the holding elements 352 cannot be pushed back again into the cylindrical housing 350 (see FIG. 8D). The holding element shown in FIGS. 8F, 8G and 8H as an individual part also shows the space 368 for the pressure spring 342. An offset path 70 receives the tip of the fixing plug 66 and makes it possible for the holding elements to carry out only a limited lifting movement. Another offset 72 makes it possible for the two holding elements which are movable relative to one another to slide next to one another.

Figure 7A:
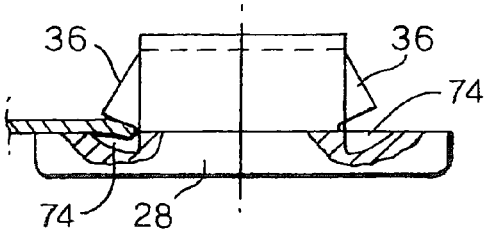
FIG. 7A is a side view of a hinge arrangement suitable for bulging sheet metal.
Figure 7B:
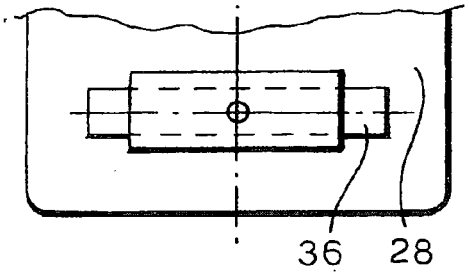
FIG. 7B is a rear view.
Figure 7C:
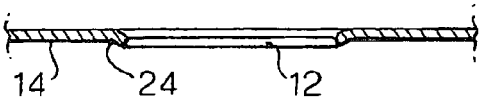
FIG. 7C is a sectional view of the associated sheet metal.

FIG. 7C is a sectional view showing a thin wall 14 of sheet metal in which areas of the opening rims bulge due to high loading. In this case, it is advantageous when the head part 28 has a recess 74 in the area of the holding elements 36 in which the bulging rim areas 24 can be received. This enables fastening without play by means of pushing the holding element 36 further.

Figure 4A:
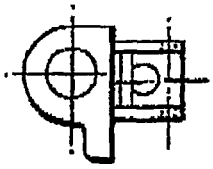
FIG. 4A is a top view.
Figure 4B:
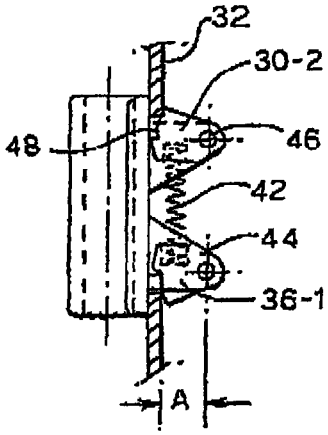
FIG. 4B is a side view of another embodiment form of a hinge according to the invention.
Figure 9C:
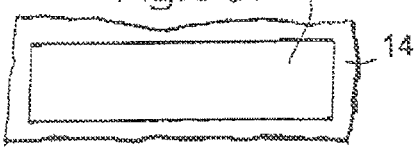
FIG. 9C shows the associated opening of the same hinge according to the invention.
Figure 9A:
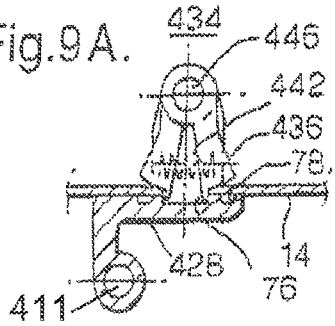
FIG. 9A shows a top view.
Figure 9B:
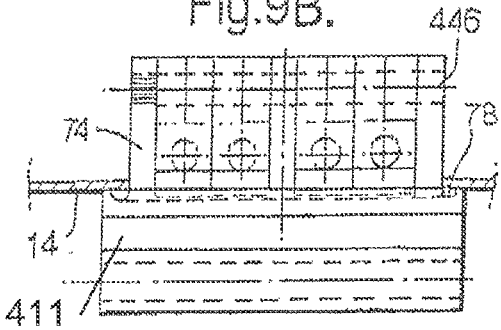
FIG. 9B shows a side view of another hinge according to the invention.
Figure 15A:
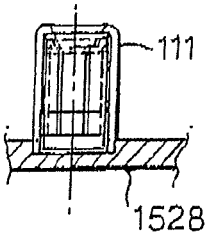
FIGS. 15A, 15B, 15C and 15D show an embodiment form in which a holding spring is screwed to a body part.
Figure 15B:
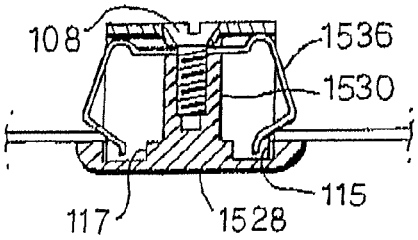
Figure 15C:
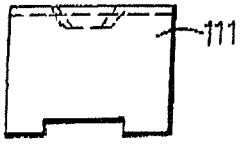
Figure 15D:
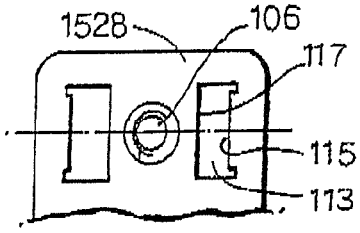
Figure 16A:
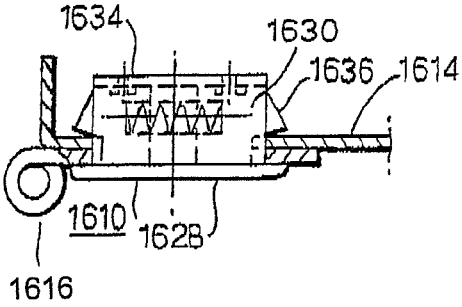
FIGS. 16A, 16B, 16C and 16D show different views of a holding element which is separate from the hinge leaf.
Figure 16B:
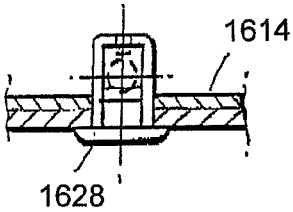
Figure 16C:
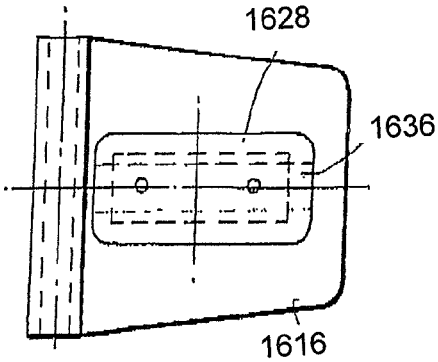
Figure 16D:
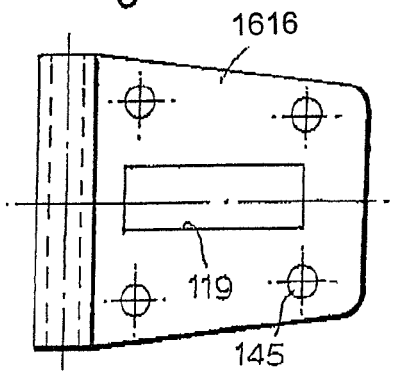

FIG. 9A is a front view and FIG. 9B is a side view showing a holding part 434 which is composed of four pairs of holding elements 436 lying next to one another. The construction is similar to that shown in FIGS. 4A, 4B, but a shared pin 446 is provided for holding the holding elements 436 that are located opposite one another. The axial pin 446 is held by means of three supports 74, one support receiving a corrugated surface of the end of the axial pin so as to press upon it.

At their ends, the holding elements 436 have a projection 76 which, in combination with a recess in the head part 428, leads to a limiting of the rotational path due to the spring force 442. The particular advantage in this respect is also that the head part 428 and the body part formed by the supports 74 can also be injection molded in a simple manner, although a groove 78 is provided in this case for a seal which would normally require sliding arrangements with injection molding dies.

Figure 24:
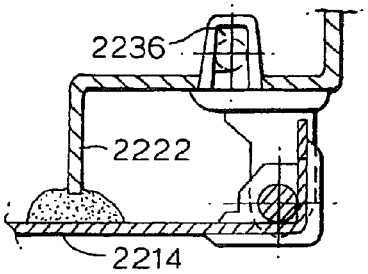
FIG. 24 shows a cross-sectional view of the corner area of a switch cabinet with two hinge parts which are fastened by means of a pin or, according to the invention, to the door leaf or to the door frame.

The hinge shown in FIG. 1A has a second hinge part 18, which is swivelably connected to the first hinge part 16, and another construction like the first hinge part 16. On the other hand, FIG. 5A shows a second hinge part 218 which is swivelably connected to the first hinge part 214 but which has a construction that differs from the first hinge part with respect to its fastening to a frame such as a door frame 222 or to a door leaf and is welded in this instance. The second hinge part can also be screwed to the frame or to the door leaf (see FIG. 25A). Alternatively, the second hinge part can also be glued to the frame or to the door leaf. Finally, it is also possible to fasten the second hinge part to the frame or to the door leaf by means of a clamping pin as in the prior art, see FIG. 24.

Figure 10:
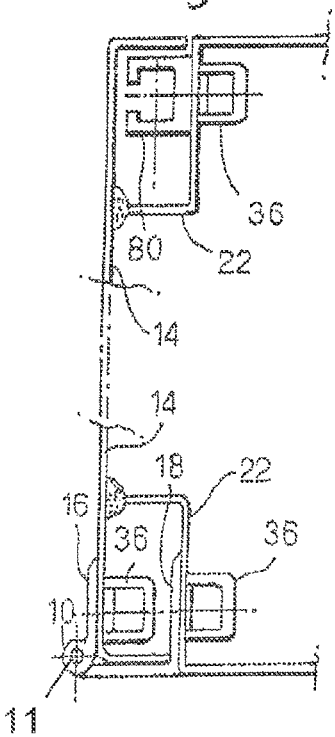
FIG. 10 shows a sheet-metal cabinet door that is hinged on a sheet-metal cabinet frame by means of the hinge devices outfitted according to the invention.

According to FIG. 10, a door 14 is swivelably connected to a frame part 22 by means of a hinge 10. The two hinge parts are held in the door frame 22 and in the door leaf 14, respectively, by means of holding elements 36.

For the sake of symmetry, it is advantageous to provide the other side of the cabinet with corresponding openings also. These openings are used for fastening a bar lock element. In the embodiment form according to FIGS. 11A, 11B, 11C, 11D, the holding elements 536 are formed by two metal pieces or plastic pieces which lie next to one another. They form projections and recesses that are directed toward one another such that the two holding elements 536-1, 536-2 can be drawn back against the force of the spring 542 by a rotatable tool or key 82 by rotating the tool 82, and the hinge can accordingly be removed from the door leaf 514. The construction is advisably carried out in such a way that the lever of tool 82 stays in the opened position automatically so that when there is a plurality of hinges they can all be brought into the open position simultaneously and all hinges can accordingly be removed from the door leaf simultaneously.

In the embodiment form according to FIGS. 11E and 11F, the tool is provided with a pinion 84 which can engage in corresponding teeth 86 of the two holding elements 636-1, 636-2 and makes it possible for the two holding elements to be drawn back into the housing when the tool and pinion 84 are turned in order to pull the housing out of the opening in the thin wall. The holding elements 636-1 and 636-2 shown in FIGS. 11E and 11F comprise surfaces 85-1 and 85-2 at their inner ends overlapping and touching one another in an area between the toothed strips 87-1 and 87-2 and the room provided for the spring 642, shown in broken lines in FIGS. 11E and 11F.

Opening is possible from the hinge side, that is, from the outer side of the door leaf area; a blind mounting can also be disassembled again.

On the other hand, the embodiment form according to FIG. 12A, 12B, 12C provides for removal by means of a tool proceeding from the inner side.

Due to the inclined surface 127 of the holding elements 736 which extends at 45° (see particularly FIG. 12C and FIG. 12G), these holding elements 736 are forced outward in the direction of the channel walls 129 by the spring pressure of the spring 742 so that friction occurs in the channel, and the holding elements are possibly already sufficiently fixed by this friction so that the fixing plug 131 shown in FIG. 12A is not needed. When the plug 131 is not required for securing the holding elements 736, the plug 131 also need not be removed when the key 133 is to be inserted through the opening 135 in the channel cover 137 in the offset area 139 formed by the two holding elements 736. When the key 133 is turned in the counterclockwise direction referring to FIG. 12A, the wings 141 of the key press against the endface 143 of the offset area 139 and move the holding element 736 into the channel until reaching the position shown in FIG. 12I, at which time the key is turned by 90° and holds by itself. The entire unit shown in FIG. 12A can then be pulled out of the opening 12 (shown in FIG. 12D) in the thin wall 714, including additional hinge elements which have likewise been brought into the pulled back position with a corresponding key.

In the embodiment form according to FIGS. 12J, 12K, 12L, 12M, 12N, 12O and 12P, the holding element is formed by a flat metal piece having an opening 85 for receiving the spring 842 and two oppositely located projections 86 which receive the spring 842 so as to secure it, so that that a handling unit is formed by the holding element and spring.

This unit can be received in the correspondingly shaped opening 88 in the body part 830 (see FIG. 12K). The cutout 90 provided for the spring is shorter than the corresponding cutout 92 for the holding element 836 so that the spring 842 obtains a contact surface when the holding element 836 is pushed into the position according to FIG. 12J.

When a knob 94 is arranged at the end of the cutout 90 for the spring, the spring can be secured at the latter and the holding element 836 is prevented from falling out with the spring 842. The embodiment form according to FIGS. 18A, 18B, 18C has a similar construction, wherein the fastening element 936 in FIG. 18D and the spring 942 in FIG. 18E are shown as fixedly assembled parts in FIGS. 18F and 18G. Holding projections are provided in FIG. 18H. In addition, the holding element 936-1 in this case may have a shape that differs from the flat shape for reasons of stability (see FIG. 18I).

In the embodiment form shown in FIGS. 19A, 19B, 19C, two springs are provided, each of which is inserted laterally into the associated holding element 1036. The other half of the spring element is received by the body part 1030. FIG. 19A shows the characteristic feature that reinforcement plates 94, 96 are provided at both sides in cases where the wall material is very thin and are clamped in by the holding elements so that they also secure and support the thin door leaf 1014.

The embodiment form according to FIGS. 19D, 19E, 19F, 19G and 19H provides two metal pieces 1136 which are located next to one another and which are held jointly by a spring 1142 in such a way that these three parts form a handling unit which is stable in itself, that is, they can be handled separately and, if required, can be inserted into a corresponding recess in the body part 1130 as can be seen in FIG. 19E.

By means of a knob 1192 arranged in this area, the construction can also be held in position.

According to FIG. 19H, the two metal parts are thicker so that, together, they can receive the spring.

FIGS. 13A, 13B and 13C show an embodiment form in which the holding part 1234 is fastened to the head part 1228 by means of spot welding 98. In FIGS. 13E, 13D, a suitably formed leaf spring serving as a holding element is spot-welded at the body part 1328 (see weld 1398).

FIGS. 14A and 14B show a hinge in which the leaf spring 1436 is inserted into a cavity 100 which is formed by the body part and which extends radially. This cavity forms a slot 102 or a projection or recess in which a projection or recess 104 of the spring 100 can lock the latter into position in a fixed manner.

In the hinge arrangement which is shown in FIGS. 15A, 15B, 15C and 15D, the leaf spring 1536 is held by a head screw 108 that is screwed into a threaded bore hole 106 formed by the body part 1530. A cover 111 can be provided for improved guidance. This cover 111 is U-shaped and engages by its leg ends in recesses 113 in the head part 1528. Further, these recesses 113 form stop surfaces 115 and 117 for the ends of the spring 1536.

FIGS. 16A, 16B, 16C and 16D show a hinge in which the hinge part has an opening 119 like the thin wall 1614, wherein the holding part 1634 and the body part 1630 have their own head part 1628. Further, the hinge part 1616 shown in FIG. 16D has bore holes 145 for an alternative fastening by means of head screws.

In the embodiment form shown in FIGS. 17A, 17B and 17C, the head part 1738 and body part 130 are two parts which are screwed together, wherein two screws 17108 are used. In order to increase stability, the pairs of holding elements 1736 are doubled and are arranged symmetrically on the right-hand and left-hand side of the screw arrangement 17108.

In the embodiment form shown in FIGS. 20A to 20L, the head part 1828 and body part 1830 are two different structural component parts which are screwed together 18107. The holding elements 1836 have an elongated hole 121 through which the screw 18107 is guided, and the axial movement of the holding element 1836 is accordingly limited. The head part 1828 forming the hinge has a groove 123 for a circumferential ring seal 125.

Figure 21:
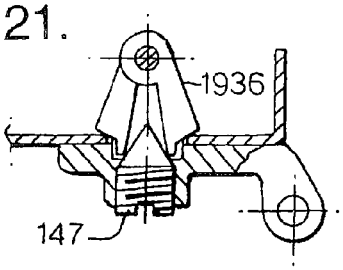
FIG. 21 shows a sectional top view of an embodiment form with a wedge screw.
Figure 23:
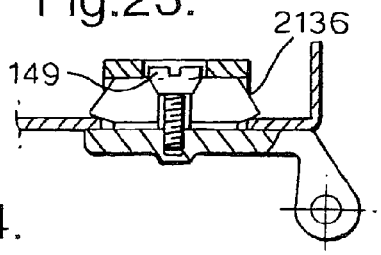
FIG. 23 shows a view similar to FIG. 21 to illustrate a wedge device in the form of a conical head screw.

FIG. 21 is a cross-sectional view in partial section showing a hinge part whose holding elements 1936 are spread by means of a screw with a conical base 147. In the embodiment form shown in FIG. 23, the head of the screw 149 is conical and presses the two holding elements 2136 apart.

Figure 22A:
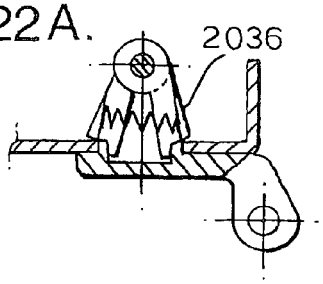
FIG. 22A shows an embodiment form with a round opening in a top view in partial section.

Compared to a construction according to FIG. 22A in which a spring spreads the two holding elements 2036, the embodiment forms with the conical screw have the disadvantage that the screw must be tightened manually when the sheet metal edges become rounded or bulge out subsequently under load. A spring readjusts automatically and compensates automatically.

Figure 2:
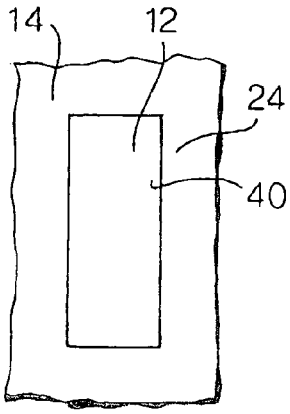
FIG. 2 shows an opening in the door leaf, which opening is suitable for the hinge which is constructed according to the invention.
Figure 22B:
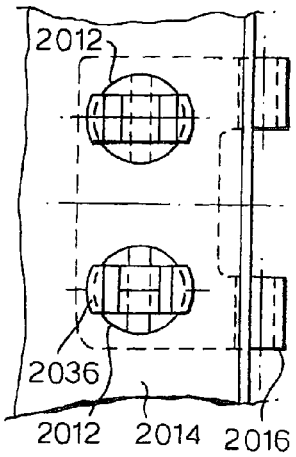
FIG. 22B is a bottom view according to FIG. 22A of a hinge part requiring two round openings.
Figure 22C:
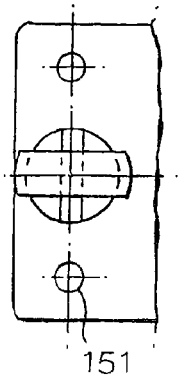
FIG. 22C shows a top view of a hinge part with a round opening and two guide holes.

The opening in the thin wall need not necessarily be rectangular as is shown, for example, in FIG. 2. In itself, it can also have any other shape, e.g., oval or round. A round embodiment form can be seen in FIG. 22B, in which case, however, means must be provided for preventing rotation, which is provided when the shape of the opening is rectangular but not when the opening is round. The first hinge part (e.g., fastened to the door) can be secured, for example, by the second hinge part in case this second hinge part is arranged securely enough (e.g., at the frame) or by the arrangement of two round openings 2012 which are arranged at a distance from one another, as is shown in FIGS. 22B, or also by additional pins 151 which are cast integral with the hinge part and which prevent rotation (see FIG. 22C) insofar as there are corresponding bore holes in the door leaf which accept these pins.

Figure 25A:
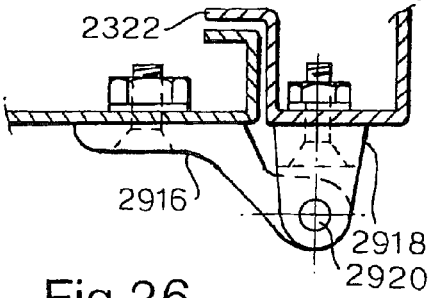
FIG. 25A shows a corner area of a switch cabinet with hinge parts fastened by screws.
Figure 25B:
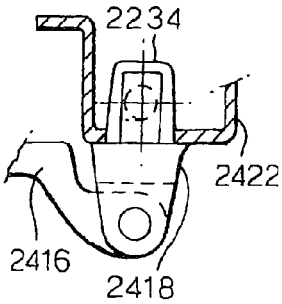
FIG. 25B shows hinge parts which are fastened according to the invention corresponding to FIG. 25A.

FIG. 25A shows a conventional hinge for flush mounting. The two hinge parts are screwed to the door leaf 2314 or in the door frame 2322. Since both hinge parts 2318, 2316 are screwed on and the holes in the frame part 2318 are accessible only in the dismantled state of the hinge, the customer must mount the hinge parts on the cabinet and hammer in the hinge pin 2320 or hold them with retaining rings, which is very time-consuming for the customer. A better solution is shown in FIG. 25B: Because it is outfitted with a holding part 2234 according to the invention, the hinge part 2418 to be fastened to the frame 2422 can be clipped in as a preassembled hinge, and the hinge part 2416 to be connected to the door leaf can be screwed to the door or clipped to it if desired.

Figure 26:
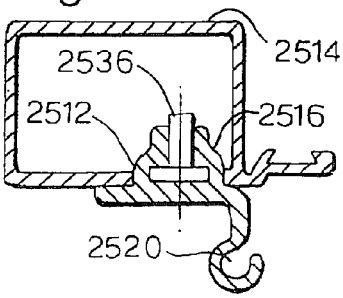
FIG. 26 is a cross-sectional view of a T-shaped clip element made of a pressed aluminum profile.

FIG. 26 is a cross-sectional view through a window frame 2514 with an elongated opening 2512 in which a hinge part

2516 made from a pressed aluminum profile can be inserted and then secured subsequently by means of a T-shaped wedge element 2536. Manufacture is more economical because the pressing tool and the production are simpler. Also, the eyelet for a pin 2520 can be left open and can accordingly be produced during the pressing process.

COMMERCIAL APPLICABILITY

The invention is commercially applicable in switch cabinet construction.

While the foregoing description and drawings represent the present invention, it will be obvious to those skilled in the art that various changes may be made therein without departing from the true spirit and scope of the present invention.

REFERENCE NUMBERS

10, 1610 handle
12, 2012, 2512 rectangular, round opening
14, 214, 514, 714, 1014, 1214, 1614, 2014, 2214, 2514 thin wall, door leaf
16, 216, 316, 516, 1616, 2016, 2416, 2516, 2916 hinge part (connected to the door)
18, 218, 2418, 2918 hinge part (connected to the frame)
20, 2520, 2920 hinge pin
22, 222, 1222, 2222, 2322 thin wall, door frame
24 rim of the opening
26 front, outer side of the thin wall 14
28 1128 head part
30, 1130 body part
32 rear, inner side of the thin wall 14
34, 434, 1634, 2234 holding part, hinge part
36, 36-1, 36-2, 136-1, 136-2, 236, 436, 536, 536-1, 536-2, 636-1, 636-2, 736, 836, 936, 936-1, 1036, 1136, 1236, 1336, 1436, 1536, 1636, 1736, 1836, 1936, 2036, 2136, 2236, 2536 holding element
38, 538 inclined surface
40 edge
42, 42-1, 42-2, 142, 242, 342, 442, 542, 742, 842, 942, 1142, 1842, spring arrangements
44 lever
46, 446 axial pin
48 stop arrangements
50, 350 rectangular cylinder
52, 352 slide
54, 154, 354 locking hook arrangement
56, 156 wedge, pin
58 axis
60 opening edge
62 bevel
64 clamping surface
66 fixing plug
368 spring space
70 offset
72 offset
74 support
76 projection
78 groove
80 bar lock
82 tool, key
84 opening
86 projections
88 recess for holding element
90 recess for spring
92, 1192 knob
94 reinforcement plate
96 reinforcement plate
98, 1398 spot weld
100 cavity
102 slot, recess
104 recess, projection
106 threaded bore hole
108, 17108 head screw
111 cover
113 recess
115 stop surface
117 stop surface
119 opening
123 groove
125 ring seal
127 inclined surface
129 channel wall
131 fixing plug
133 detaching key
135 opening
137 channel cover
139 offset area
141 wing
143 surface
145 bore holes
147 screw with conical base
149 screw with conical head
151 pin
18108 screw
85-1, 85-2 overlapping surfaces
87-1, 87-2 toothed strips
1136 metal piece
1142 compression spring
1190 rectangular opening

What is claimed is:

1. A hinge in combination with a thin wall, the thin wall having an outer side, and inner side opposite the outer side, and an opening having a rim, comprising:

a first hinge part mounted on the thin wall;

a second hinge part swivelably connected to the first hinge part by a pivot pin;

the first hinge part comprising a head part abutting the outer side of the thin wall;

a body part protruding from the head part, the body part inserted through the opening, the body part including a guide channel formed by a plurality of side wall and a bottom wall, the guide channel positioned on the inner side of the thin wall; and a holding part which is carried by the body part;

said holding part being formed by holding elements which project in a resilient manner from the body part in the direction of its outer surface and whose free end has:

(1) a first smooth inclined surface which, when assembled, contacts the rim of the opening so as to support the body part on the rim of the opening without play, the first smooth inclined surface having an inclination angle being greater than 0° and less than 45° with respect to a direction of the first smooth inclined surface's sliding movement, and the holding elements being secured to the rim by a friction force generated at a support area between the rim and the first smooth inclined surface that hinders the holding element from being pushed outward out of the opening at a support position and supports the body part on the rim of the opening without play; and (2) a second smooth inclined surface which enables the holding part and the body part to be pushed through the opening to reach a support position, the two inclined surfaces being inclined with respect to a plane of the thin wall;

wherein the holding elements are formed by two flat pieces lying next to one another with a flat surface of one flat piece of the two flat pieces touching a flat surface of the other flat piece of the two flat pieces, each flat piece having a rectangular opening, these two openings together forming a rectangular space which receives a spiral pressure spring by at least a portion of its diameter; and wherein an axis of the spring is arranged along a plane located between the two holding elements.

2. The hinge according to claim 1;

wherein two holding elements which are arranged diametrical to one another are provided and are acted upon by pressure elements such as spring arrangements, particularly a coil spring common to the two holding elements or two coil springs, or wedge arrangements such as conical screws.

3. The hinge according to claim 1;

wherein the holding elements are slides which are arranged so as to be displaceable in a channel that lies parallel to the plane of the thin wall and is rectangular in cross section and are held against the force of a pressure spring by a hook arrangement that locks between the slides themselves or in the channel.

4. The hinge according to claim 1;

wherein the holding elements are slides of rigid material such as metal which are arranged so as to be displaceable in a channel that is parallel to the plane of the thin wall and rectangular in cross section and are held against the force of a pressure spring by a pin arrangement that is arranged between them.

5. The hinge according to claim 3;

wherein the channel has a partial dividing wall or undercut or opening edge at which the slides are supported axially by a shoulder or hook.

6. The hinge according to claim 1;

wherein the two flat pieces of the holding elements are held jointly by the spring in such a way that these three parts, independent of the body part, form a manageable unit that is stable in itself.

7. The hinge according to claim 4;

wherein a fixing pin or fixing plug or fixing screw is provided for fixing the holding elements after the hinge part is mounted in the opening.

8. The hinge according to claim 1;

wherein the head part has a recess in the area of the holding elements.

9. The hinge according to claim 1;

wherein a plurality of holding elements are arranged next to one another in axial direction of the hinge.

10. The hinge according to claim 1;

wherein the second hinge part which is swivelably connected to the first hinge part has a construction analogous to that of the first hinge part.

11. The hinge according to claim 1;

wherein a second hinge part which is swivelably connected to the first hinge part has a construction differing from that of the first hinge part with respect to its fastening to a frame, such as a door frame, or to a door leaf.

12. The hinge according to claim 1;

wherein the body part has a rectangular cross section, so that the at least one hinge part is configured to be mounted in a rectangular opening in a thin wall.

13. The hinge according to claim 1, wherein the two flat pieces are selected from the group of two flat metal pieces or two flat plastic pieces.

14. The hinge according to claim 1, wherein each of the two flat pieces further includes an extension portion connected with a corresponding free end and directed to the extension portion of another flat piece.

* * * * *